US008365795B2

(12) United States Patent
Perkowitz

(10) Patent No.: US 8,365,795 B2
(45) **Date of Patent: *Feb. 5, 2013**

(54) WINDOW SHADE AND METHOD OF USE THEREOF

(75) Inventor: David Perkowitz, Vernon Hills, IL (US)

(73) Assignee: Horizons Window Fashions, Inc., Gurnee, IL (US)

( * ) Notice: Subject to any disclaimer, the term of this patent is extended or adjusted under 35 U.S.C. 154(b) by 164 days.

This patent is subject to a terminal disclaimer.

(21) Appl. No.: 12/917,232

(22) Filed: Nov. 1, 2010

(65) Prior Publication Data

US 2011/0100569 A1 May 5, 2011

Related U.S. Application Data

(60) Provisional application No. 61/257,213, filed on Nov. 2, 2009.

(51) Int. Cl.
*A47H 5/00* (2006.01)

(52) U.S. Cl. ..... 160/84.01; 160/84.04; 160/243

(58) Field of Classification Search ..... 160/84.04, 160/84.01, 178.1 R, 243, 84.06, 348; 24/115 F
See application file for complete search history.

(56) References Cited

U.S. PATENT DOCUMENTS

| | | | | |
|---|---|---|---|---|
| 1,482,978 | A | 2/1924 | Edwards | |
| 2,049,518 | A | 8/1936 | Schier | |
| 3,160,202 | A * | 12/1964 | Rosen | 160/344 |
| 4,817,698 | A | 4/1989 | Rossini et al. | |
| 4,921,032 | A | 5/1990 | May | |
| 5,495,883 | A * | 3/1996 | Jelic | 160/84.04 |
| 5,513,687 | A | 5/1996 | Tuzmen et al. | |
| 5,613,540 | A | 3/1997 | Jelic | |
| 5,645,685 | A | 7/1997 | Furhman | |
| 5,706,876 | A | 1/1998 | Lysyj | |
| 5,709,258 | A | 1/1998 | Coccoluto | |
| 5,722,478 | A | 3/1998 | Claypool et al. | |
| 5,743,319 | A * | 4/1998 | Christopherson | 160/173 R |
| 5,778,957 | A | 7/1998 | Torgersen | |
| 5,797,441 | A | 8/1998 | Benthin | |
| 5,894,876 | A | 4/1999 | O'Brien | |
| 5,918,657 | A * | 7/1999 | Tuzmen | 160/168.1 R |
| 6,089,303 | A | 7/2000 | Metcalf et al. | |
| 6,179,035 | B1 | 1/2001 | Anderson | |
| 6,463,987 | B1 | 10/2002 | Nevins | |
| 6,543,516 | B2 | 4/2003 | Hwang | |
| 6,644,374 | B2 | 11/2003 | Nien | |

(Continued)

FOREIGN PATENT DOCUMENTS

WO 2010021841 2/2010

OTHER PUBLICATIONS

United States Patent & Trademark Office Action dated Oct. 7, 2004; U.S. Appl. No. 10/697,109, filed Oct. 31, 2003; Conf. No. 8424; Inventor Henry Lin.

(Continued)

*Primary Examiner* — David Purol
(74) *Attorney, Agent, or Firm* — McCracken & Frank LLC

(57) ABSTRACT

A window shade that reduces the risk of an individual becoming entangled in cords used to operate the shade includes a headrail adapted for horizontal mounting above a window, a shading material attached to the headrail, and at least one cord for raising and lowering the shading material. The cord is attached to a location adjacent a lower end of the material, and extends upward through cord guides toward the headrail. The cord is encased within a collapsible shroud attached to each cord guide. The shroud is adapted to longitudinally extend as the shading material is lowered toward a deployed position, and then longitudinally collapse as the shading material is raised toward a stowed position.

20 Claims, 10 Drawing Sheets

U.S. PATENT DOCUMENTS

| | | | | |
|---|---|---|---|---|
| 6,662,845 | B1 | 12/2003 | Palmer | |
| 6,752,194 | B1 | 6/2004 | Huang | |
| 6,792,995 | B2 | 9/2004 | Judkins | |
| 7,124,801 | B2 * | 10/2006 | Ng et al. | 160/84.04 |
| 7,198,087 | B2 | 4/2007 | Hsu | |
| 7,624,784 | B2 | 12/2009 | Anthony et al. | |
| 7,673,665 | B2 | 3/2010 | Rossato | |
| 7,823,620 | B2 | 11/2010 | Kirby | |
| 7,823,953 | B2 | 11/2010 | Haas | |
| 7,823,955 | B2 | 11/2010 | Alacqua et al. | |
| 7,828,036 | B2 | 11/2010 | Tran | |
| 7,828,037 | B2 | 11/2010 | Crider | |
| 7,828,038 | B2 | 11/2010 | Livacich | |
| 7,828,039 | B2 | 11/2010 | Starzmann et al. | |
| 7,828,040 | B2 | 11/2010 | Miyachi et al. | |
| 7,828,041 | B2 | 11/2010 | Schlecht | |
| 7,830,600 | B2 | 11/2010 | Jiang | |
| 7,832,052 | B2 | 11/2010 | Vrielink | |
| 7,832,450 | B2 | 11/2010 | Brace et al. | |
| 7,832,451 | B2 | 11/2010 | Miller et al. | |
| 7,832,452 | B2 | 11/2010 | Deschenes | |
| 7,832,453 | B2 | 11/2010 | Lin | |
| 7,832,454 | B2 | 11/2010 | Lyons | |
| 7,832,455 | B1 | 11/2010 | Johnston et al. | |
| 7,833,368 | B2 | 11/2010 | Judkins | |
| 7,836,936 | B2 | 11/2010 | Graichen | |
| 7,836,937 | B2 | 11/2010 | Anderson et al. | |
| 7,841,027 | B2 | 11/2010 | Sample | |
| 7,841,376 | B2 | 11/2010 | Lin | |
| 7,841,377 | B2 | 11/2010 | Coenraets | |
| 7,841,378 | B2 | 11/2010 | Henning | |
| 7,843,640 | B2 | 11/2010 | Hooper, Jr. | |
| 7,845,383 | B2 | 12/2010 | Bowman | |
| 7,931,066 | B2 | 4/2011 | Honda et al. | |
| 2005/0092448 | A1 | 5/2005 | Lin | |
| 2007/0277935 | A1 | 12/2007 | Lin | |
| 2008/0295975 | A1 | 12/2008 | Lin | |
| 2010/0252209 | A1 | 10/2010 | Wang | |
| 2010/0276088 | A1 | 11/2010 | Jelic et al. | |
| 2010/0276089 | A1 | 11/2010 | Jelic et al. | |
| 2010/0276090 | A1 | 11/2010 | Zagone | |
| 2010/0276091 | A1 | 11/2010 | Niswonger | |
| 2010/0280666 | A1 | 11/2010 | Marchetto | |
| 2010/0282418 | A1 | 11/2010 | Lucas | |
| 2010/0282419 | A1 | 11/2010 | Ligas, Sr. | |
| 2010/0282420 | A1 | 11/2010 | Lai | |
| 2010/0282421 | A1 | 11/2010 | Lin | |
| 2010/0288446 | A1 | 11/2010 | Foley et al. | |
| 2010/0288447 | A1 | 11/2010 | Filipiak, Jr. et al. | |
| 2010/0288448 | A1 | 11/2010 | Hormann et al. | |
| 2010/0288449 | A1 | 11/2010 | Chang et al. | |
| 2010/0288450 | A1 | 11/2010 | Bruck et al. | |
| 2010/0288451 | A1 | 11/2010 | Bohlen | |
| 2010/0288452 | A1 | 11/2010 | Coenraets | |
| 2010/0288453 | A1 | 11/2010 | Richardson | |
| 2010/0288454 | A1 | 11/2010 | Lin et al. | |
| 2010/0288455 | A1 | 11/2010 | Liscano | |
| 2010/0294437 | A1 | 11/2010 | Gonzales | |
| 2010/0294438 | A1 | 11/2010 | Kirby et al. | |
| 2010/0294439 | A1 | 11/2010 | Su | |
| 2010/0294440 | A1 | 11/2010 | Li et al. | |
| 2010/0294441 | A1 | 11/2010 | Ligas, Sr. et al. | |
| 2010/0294442 | A1 | 11/2010 | Lange | |
| 2011/0005690 | A1 | 1/2011 | Harding | |
| 2011/0017410 | A1 | 1/2011 | Yamashita et al. | |
| 2011/0017411 | A1 | 1/2011 | Yeh | |
| 2011/0024065 | A1 | 2/2011 | Lin | |
| 2011/0036512 | A1 | 2/2011 | Su | |
| 2011/0036517 | A1 | 2/2011 | Chen | |
| 2011/0036518 | A1 | 2/2011 | Yang | |
| 2011/0048652 | A1 | 3/2011 | Chen | |
| 2011/0048653 | A1 | 3/2011 | Mccarty et al. | |
| 2011/0048657 | A1 | 3/2011 | Tung et al. | |
| 2011/0056633 | A1 | 3/2011 | Lin | |
| 2011/0067819 | A1 | 3/2011 | Huang | |
| 2011/0073260 | A1 | 3/2011 | Kollman et al. | |
| 2011/0083814 | A1 | 4/2011 | Lane | |
| 2011/0083816 | A1 | 4/2011 | Chen | |
| 2011/0083818 | A1 | 4/2011 | Cross | |
| 2011/0126990 | A1 | 6/2011 | Huang | |
| 2011/0180221 | A1 | 7/2011 | Huang | |

OTHER PUBLICATIONS

2nd Provisional American National Standard for Safety of Corded Window Covering Products, dated Sep. 3, 2010, ANSI/WCMA A100.1-2010 (PS2), pp. 1-46, Window Covering Manufacturing Association (WCMA), Revision of Provisional ANSI/WCMA A100.1-2009.

* cited by examiner

WINDOW SHADE AND METHOD OF USE THEREOF

CROSS REFERENCE TO RELATED APPLICATIONS

This patent application claims the benefit of U.S. Provisional Application No. 61/257,213, filed Nov. 2, 2009, the contents of which are incorporated herein by reference.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Background

The present invention generally relates to window shades, and more particularly to a window shade having a pull cord encased within a collapsible shroud to prevent a child's head from becoming entangled in the pull cord.

2. Description of the Background

Various types of window coverings are known, including roller shades and Roman shades, which are also generally referred to as blinds. Roman shades typically comprise a shade suspended from a headrail. The shading material, which may be formed from a variety of materials including paper, cloth, other fabrics, and plastic and wood members, is typically moved to a stowed configuration and maintained in such configuration by a string or other type of cord attached to the shade at or near its bottom edge. The shade is then deployed by letting out the string to lower the bottom edge and, with it, the remainder of the shade. The cord is typically disposed along an outer face of the shade, and may be attached to spaced portions of the shade to promote uniform folding of the shade as the shade is being raised by the cord.

With the blind fully deployed, the cord can attract the attention of a child. An infant or toddler can become entangled in a loose cord, and may be strangled by placing his/her head between the cord and the shade. Therefore, improvements in blinds have been developed to reduce the risk of such tragedies. A blind with a safety arrangement is disclosed in Lin U.S. Patent Publication No. 2005/0092448. The blind comprises a headrail, a brake mechanism proximate the headrail, a pair of cord portions that pass through the brake mechanism, and a shade cloth. The shade cloth has a lower end secured to ends of the cord portions and the cord portions extend upwardly adjacent a rear face of the shade cloth through cord covers formed of a soft material, such as yarn. A plurality of spaced positioning elements are stitched to the cord cover and to the shade cloth. Pulling ends of the cord portions adjacent a front face of the shade cloth causes the positioning elements, except the topmost positioning element, to move upwardly, thereby causing the shade cloth to wrinkle upwardly. Also, the cord covers are contracted together. Lin notes that: "a dangerous ring will not be formed by the cord and the cord covers in operation." However, Lin does not disclose the structure or configuration of the positioning elements, and therefore, does not teach in sufficient detail how such a blind may be satisfactorily constructed with materials that are aesthetically pleasing, easy to operate, and long-lasting in use. In this regard, the use of a material, such as a low-strength yarn, for the cord covers, can lead to wear and failure of the cord covers at the point(s) of attachment of one or more of the positioning elements to the shade cloth, thereby resulting in the possibility that the a dangerous loop could be formed.

SUMMARY OF THE INVENTION

The present invention provides a window shade capable of reducing the risk of an individual becoming entangled in a cord used to raise and lower a shade.

According to a first aspect of the invention, a window shade includes a headrail adapted for mounting adjacent a window, and a shading material having a first end attached to the headrail, a second end opposite the first end, and a first face between the first and second ends. A cord is disposed adjacent the face for moving the shading material between a stowed position in which the shading material is collected adjacent the headrail and a deployed position in which at least a portion of the shading material extends away from the headrail. A shroud defines an internal passage through which the cord extends wherein the shroud is adapted to extend longitudinally as the shade portion is moved toward the deployed position and the shroud is adapted to collapse longitudinally as the shade portion is moved toward the stowed position. First, second, and third spaced cord guides are provided each being made of a rigid material and extending outwardly from the face, wherein the first cord guide is disposed at a first location, the second cord guide is disposed at a second location farther away from the headrail than the first location, and the third cord guide is disposed at a third location farther away from the headrail than the first and second location. The cord is secured to the shading material at a fourth location farther away from the headrail than the third location and each cord guide includes a first portion secured to the shading material and a second portion extending away from the first portion and toward the shroud and secured to at least a portion of the shroud. The cord is at least partially surrounded by the cord guide and the shroud is substantially unsecured to the shading material at at least one location between adjacent cord guides.

According to a further aspect of the invention, a window shade comprises a headrail adapted for horizontal mounting adjacent and above a window, and a shading material having an upper end attached to the headrail and a lower end opposite the upper end. Means are provided for raising and lowering the shading material relative to the headrail to define, respectively, a stowed position in which the shading material is collapsed and collected beneath the headrail and a deployed position in which the shading material is adapted to at least partially cover the window. The raising and lowering means comprise a cordlock mechanism mounted on the headrail and at least first and second cords that are each attached to the shading material adjacent the lower end thereof and extend upward toward the headrail and through the cordlock mechanism. First and second sets of cord guides are disposed on the shading material, each set of the first and second sets of cord guides being substantially vertically aligned so that a lowermost cord guide thereof is in proximity to the lower end of the shading material and an uppermost cord guide thereof is in proximity to the headrail. The first cord passes through the first set of cord guides and is attached to the lowermost cord guide and the second cord passes through the second set of cord guides and is attached to the lowermost cord guide. First and second collapsible shrouds are attached to each cord guide of the first and second sets of cord guides, respectively, wherein each of the first and second collapsible shrouds defines an internal passage extending in a longitudinal direction thereof, and wherein the first and second cords are entirely disposed within the internal passages of the first and second shrouds, respectively, between the uppermost and lowermost cord guides of the first and second sets of cord guides, respectively. The first and second collapsible shrouds are adapted to longitudinally extend as the shading material is lowered toward the deployed position and the first and second collapsible shrouds are adapted to longitudinally collapse as the shading material is raised toward the stowed position. Each cord guide includes a first rigid portion secured to the shading material and a second rigid portion secured to the shading material.

A method of use of a shade is also disclosed and claimed herein.

A significant advantage of this invention is that the cord is encased within the collapsible shroud, and is therefore unable to become loose and hang free from the shade. As a result, the cord is less likely to pose a risk to children and toddlers. According to a preferred aspect of the invention, the cord guides are spaced sufficiently close together to preclude a child from placing his or her head between the collapsible shroud and the shading material, and therefore between the cord and shading material.

Other aspects and advantages of this invention will be better appreciated from the following detailed description.

DETAILED DESCRIPTION OF THE DRAWINGS

Figure 1:
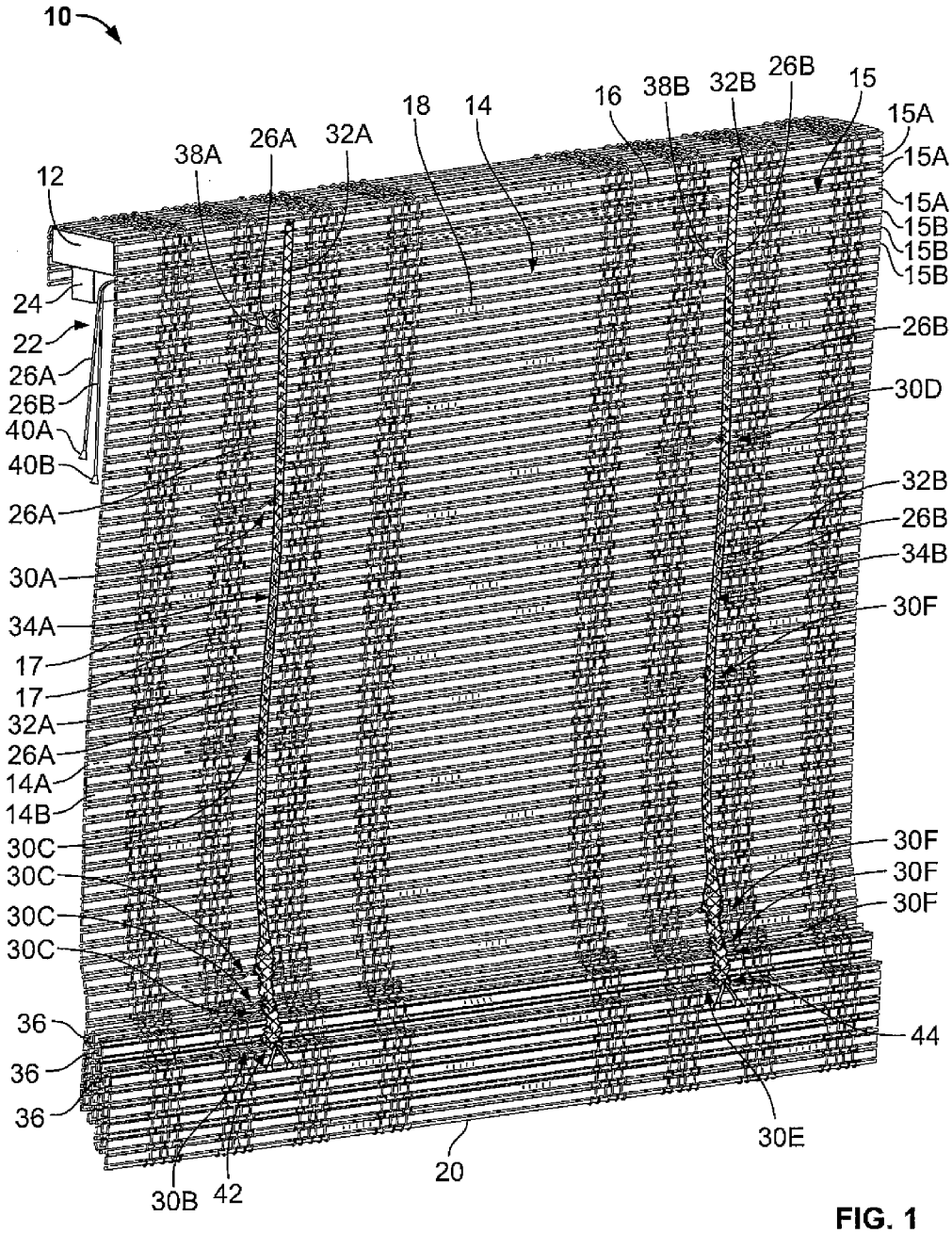
FIG. 1 comprises a rear isometric view of a window shade 10 in accordance with an embodiment of the present invention.

FIG. 1 depicts a Roman-type window shade 10, though it will become evident that the benefits of the present invention can be applied to other types of window shades. To facilitate the description of the shade 10 provided below, the terms "vertical," "horizontal," "front," "rear," "side," "upper," "lower," "above," "below," etc., may be used, in which case such terms reference the viewpoint of an operator facing a window in or on or adjacent to which the shade 10 is installed. For example, the shade 10 is preferably adapted to be mounted above a window or within a window casing to allow a shading material 14 of the shade 10 to hang vertically downward and serve as a window treatment for the window.

In the embodiment shown in FIG. 1, the shading material is formed of a plurality of wood sections 15. The wood sections 15 generally alternate between thin flat sections 15A and circular rod sections 15B. The wood sections 15 are held together by weaving cords 17.

Alternatively, the shading material 14 may be formed of a variety of materials and provide a range of shading effects. For example, the shading material 14 may be completely opaque or have some degree of translucency. Other nonlimiting examples of suitable materials for the shading material 14 include one or more pieces of paper, one or more pieces of cloth fabrics, wooden and bamboo slats, one or more metal pieces, and plastic materials. More generally, the shading material 14 may be formed from a single piece of material or multiple individual pieces of one or more materials held together in some manner to form a flexible structure. Depending on the intended installation, either or both of front and rear faces or surfaces 14A and 14B, respectively, of the shading material 14 can be decorative.

The shading material 14 has a first or upper end 16 attached to a headrail 12, wherein the latter is adapted to be horizontally mounted adjacent and/or above a window with any suitable type of hardware (not shown). As a result, the shading material 14 is suspended to hang downward from the headrail 12 so that a portion 18 of the material 14 is able to serve as a shade in front of the window. A second or lower end of the shading material 14 relative to the headrail 12 defines a lower edge 20 of the shade portion 18. The shading material 14 is movable between a stowed position in which the material 14 is collapsed and collected (preferably folded) beneath the headrail 12. For example, the entire shade portion 18 can be further raised from the position shown in FIG. 1 so that the remainder of the shade portion 18 between the headrail 12 and the folds 36 also becomes folded. By further lowering the shade portion 18 from the position shown in FIG. 1, the shading material 14 is movable to a partially or fully deployed position in which the material 14 is preferably capable of substantially or completely covering the window.

The shade 10 further includes a mechanism 22 for raising and lowering the shading material 14 relative to the headrail 12. In the embodiment of FIG. 1, such a mechanism 22 comprises a cordlock 24 (shown diagrammatically) mounted beneath the headrail 12, and one or more cords 26 (seen in FIG. 1 as cords 26A, 26B) secured to the rear face 14B of the shading material 14 above or adjacent the lower edge 20 of the shade portion 18. The cords 26 are supported in the cordlock 24 by one or more pulleys (not shown) and are routed through the cordlock 24, from which ends 40A, 40B of the cords 26 hang downward and are accessible to one wishing to operate the shade 10. As known in the art, the cordlock provides a latching mechanism by which the shading material 14 can be locked in any position between the stowed and deployed positions.

Various other mechanisms for raising and lowering the shading material 14 are well known in the art and within the scope of the invention. For example, the mechanism 22 may comprise a clutch system (not shown). With a clutch system, the lift cord(s) 26 wrap around a shaft to raise and lower the shade. The clutch has a looped cord or chain that is pulled to rotate the shaft. Alternatively, the shade can be motorized, whereby a tube motor (not shown) is installed inside a tube (also not shown) to rotate same. In the tube motor system, the cord(s) 26 wrap around the tube and rotation of the tube raises and lowers the shade. These types of alternative raising and lowering mechanisms are well known to one of ordinary skill in the art.

Figure 2:
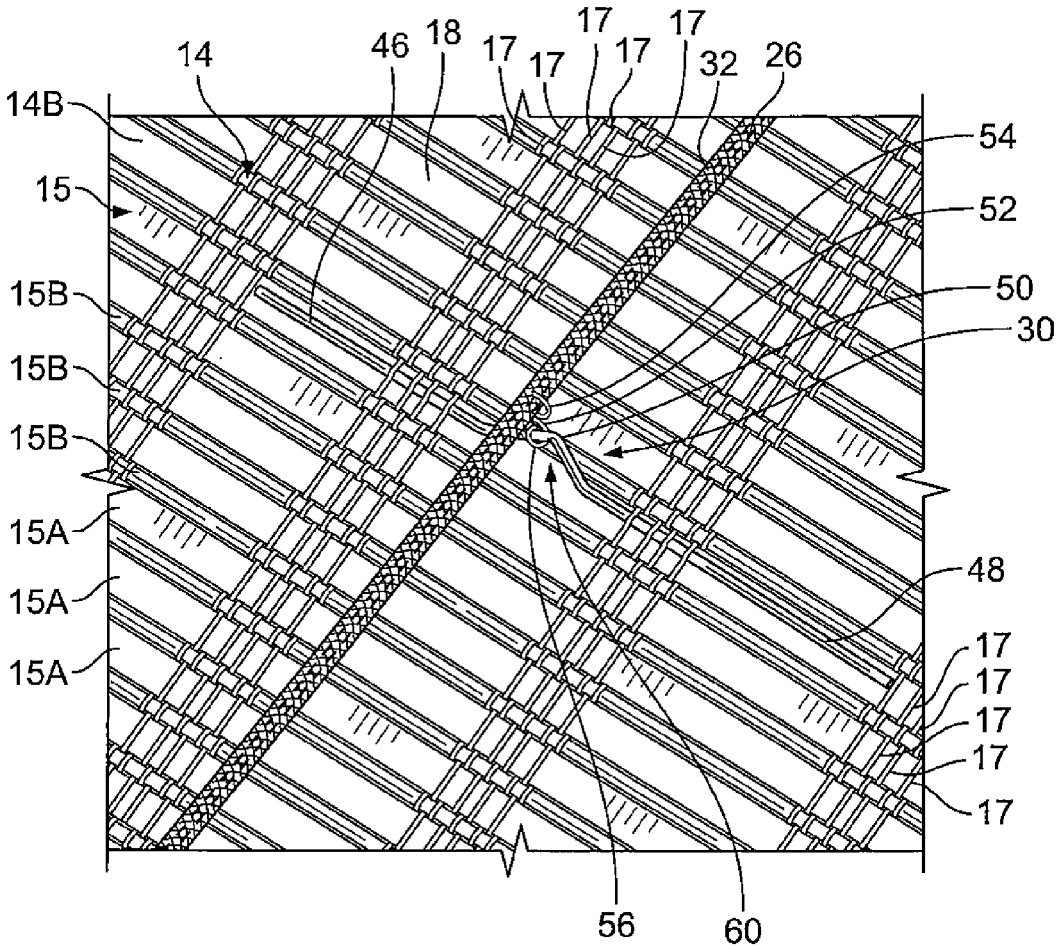
FIG. 2 comprises a fragmentary, isometric, enlarged view of the shade 10 of FIG. 1 showing the interrelation of a shading material 14, cord 26, cord guide 30 including wire 52, and shroud 32.
Figure 5:
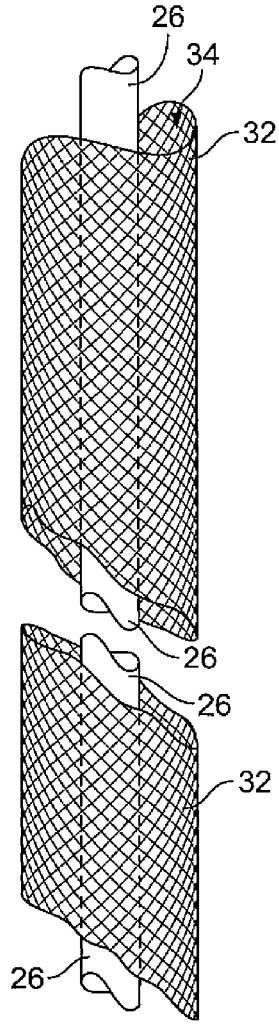
FIG. 5 comprises an enlarged, fragmentary, isometric view of the shroud 32 and encapsulated cord 26.

In the embodiment seen in FIG. 1, the cords 26A, 26B are routed through the cordlock 24 and extend through grommets 38A, 38B crimped or otherwise secured about openings in the material 14. As discussed in greater detail below, collapsible shrouds 32A, 32B are sewn to or otherwise secured to the material 14 at spaced locations. As illustrated in FIG. 5, each shroud 32A, 32B preferably has a roughly tubular (i.e., hollow) shape and defines an internal passage 34A, 34B, respectively, that extends in a longitudinal direction downwardly adjacent the rear face 14B of the material 14. As noted in greater detail hereinafter, each shroud 32A, 32B is loosely woven with gaps in the weave thereof. The cords 26A, 26B extend into the shrouds 32A, 32B, respectively, in the vicinity of the grommets 38A, 38B passing through one of the gaps in the weave of the shrouds 32A, 32B. The cords 26A, 26B extend downwardly adjacent the rear face 14B and are preferably entirely encased in the collapsible shrouds 32A, 32B between the points at which the cords 26A, 26B respectively enter the shrouds 32A, 32B in the vicinity of the grommets 38A, 38B and lowermost locations 42, 44 of attachment of the cords 26A, 26B and shrouds 32A, 32B to the material 14, as is illustrated in FIGS. 1 and 2. The collapsible shrouds 32 are preferably constructed so that they are able to longitudinally extend as the material 14 is lowered toward the deployed position, as evident from those portions of the shrouds 32 disposed above the folds 36 in FIG. 1. The shrouds 32 are also preferably constructed so that they are able to longitudinally collapse as the material 14 is raised toward the stowed position, as is evident from those portions of the shrouds 32 disposed within the folded section of the shade portion 18 in FIG. 1. For this reason, the shrouds 32 are preferably fabricated from a loosely woven flexible material, for example, such that the cords 26 might be seen through the gaps in the shrouds 32. The loosely woven material can be formed by a variety of materials, with low-friction polymeric yarn materials being preferred to minimize friction with the cords 26. The polymeric yarn is preferably 100% polyester, and may be woven on a crochet or knitting machine. Preferably, the cords 26 are also made of polyester material so as to minimize frictional forces and allow the cords 26 and shroud 32 to slide easily past each other without undue wear.

Figure 3:
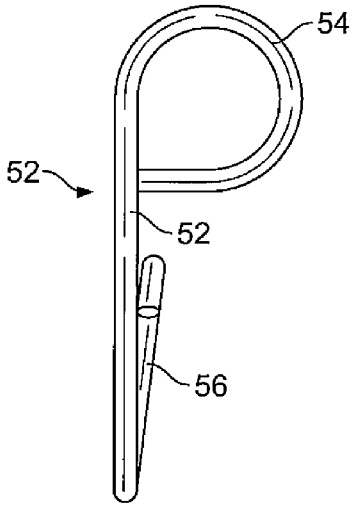
FIG. 3 comprises a side elevational view of the wire 52 shown in FIGS. 1 and 2.
Figure 4:
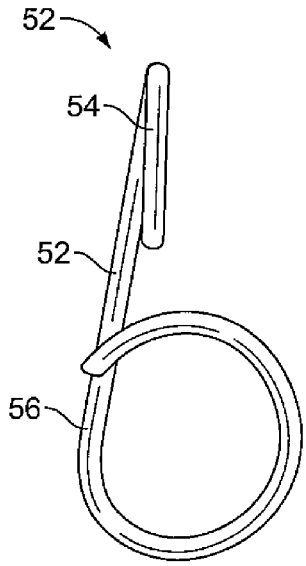
FIG. 4 comprises a front elevational view of the wire 52 shown in FIGS. 1-3.

The shrouds 32A, 32B may be attached to the upper end 16 of the material 14 with staples that extend into the headrail 12. The shrouds 32 may alternatively or in addition be sewn, bolted, nailed, glued, or otherwise attached to the upper end 16 and/or headrail 12. In a first embodiment seen in FIGS. 1 and 2, each shroud 32A, 32B is also secured to at least one, and preferably a plurality of spaced associated cord guides 30A-30C and 30D-30F, respectively, that are in turn secured to the rear face 14B of the shading material 14. In the first embodiment, the cord guides 30A-30C are preferably vertically aligned with one another, as are the cord guides 30D-30F, and each cord guide 30A-30F has two rod shaped segments 46, 48 separated by a bend or elbow segment 50. The rod shaped segments 46, 48 and the bend or elbow segment 50 together define at least one, and, more particularly two opposed hooked portions as can be seen in FIG. 2. The rod shaped segments 46, 48 are secured to the shading material 14 by the weaving cords 17. Each cord guide 30A-30F further includes a wire 52. Each shroud 32A, 32B is secured to each elbow segment 50 of the associated cord guides 30A-30C and 30D-30F, respectively, by means of the wire 52. As seen in FIGS. 3 and 4, the wire 52 has a first portion 54, a second portion 56, and a straight connecting portion 58. The first portion 54 is offset from the second portion 56 by substantially ninety degrees, such that the two portions 54, 56 lie substantially in perpendicular planes of space. A first end of each wire 52 may be passed through gaps between adjacent strands of the woven material of the shroud 32 after or prior to attaching the cord guides 30A-30C and 30D-30F to the material 14. The first end of the wire 52 may then be bent into preferably a curved or hooked shape, including an open loop, a closed loop, or a plurality of open and/or closed loops, to form the first portion 54. The first portion 54 thereby prevents the wire 52 from becoming removed from the associated shroud 32. A second end of the wire 52 is inserted into a gap 60 between the elbow 50 and the shading material 14, then bent preferably into a curved or hooked shape, including an open loop, a closed loop, or a plurality of open and/or closed loops, to form the second portion 52. The second portion 56 thereby prevents the wire 52 from becoming removed from the cord guide 30. As an alternative, each wire 52 may be pre-formed with first and second portions 54, 56 and/or the first and second portions 54, 56 of the wires 52 may be wound about one or more strands of the woven material of the shroud 32 and about the elbow 50 of the associated cord guide 30. Still further, multiple wires may alternatively be used to provide redundancy and improve strength. Alternatively, or in addition to the wire 52, the shroud 32 and, possibly, the encompassed cord 26, may be attached to the cord guide 30 and shading material 14 by extending the shroud 32 and, optionally, the cord 26, through the gap 60 during assembly. The wires 52 and cord guides 30 are preferably made of a suitable metal, such as stainless or other steel, but may instead be made of another material, such as plastic, wood, rubber, or any other suitable material. The wires 52 and cord guides 30 may be uncoated or may be covered by a coating, such as polytetrafluoro ethylene, to reduce friction, improve strength, or to obtain any other operational or assembly advantage. The attachment mechanisms that attach the cord guides 30 to the shrouds 32, as well as the cord guides 30 themselves, are not limited to the structures identified above but may alternatively comprise sewn thread, looped fabric, adhesive or other tape, rings, eyelets, grommets, or any other suitable structures and/or materials.

Each shroud 32A, 32B is preferably secured to each of the guides 30A-30C and 30D-30F, respectively, associated therewith, and is further preferably secured to the material 14 in the vicinity of the grommets 38A, 38B at the upper end 16 of the material 14. Preferably, although not necessarily, the shrouds 32 are otherwise not attached to the material 14. Each cord 26A, 26B inside of the shroud 32 is routed through associated uppermost guides 30A and 30D located in proximity to the headrail 12, through one or more associated intermediate cord guides 30C and 30F, and is attached to associated lowermost cord guide 30B and 30E nearest the lower end 20 of the material 14. The shrouds 32 and cords 26 may be tied in a knot around the lowermost cord guides 30B and 30E. Preferably, the cords 26 and shrouds 32 are knotted together to the lowermost cord guides 30B and 30E to make one cohesive knot. In other embodiments, each cord 26 and shroud 32 may be knotted separately to the same or different portions of the associated cord guide 30B, 30E. Adhesive, bonding, or other means of attachment may also or alternatively be used. In each event, the portions of the shrouds 32 and the cords 26 disposed between adjacent pairs of cord guides 30 are only able to be displaced a limited distance from the shading material 14, and such distance is determined at least in part by the spacing distance between adjacent cord guides 30A-30C and 30D-30F, and the resiliency of the cords 26 and/or shrouds 32.

Alternatively, the shrouds 32A, 32B and cords 26A, 26B may extend through the cord guides 30A-30C and 30D-30F and may be secured to the material 14 at locations below the lowermost cord guides 30B and 30E. In this event, each shroud 32A, 32B is secured to the associated cord guides 30A-30C and 30D-30F, respectively, and each cord 26A and 26B optionally extends through one or more of the associated cord guides 30A-30C and 30D-30F, respectively.

In use, the shade portion 18 of the window shade system 10 can be raised and lowered between the stowed and deployed positions by grasping the ends 40 of the cords 26 hanging downwardly from the cordlock 24. As illustrated in FIG. 1, by pulling the ends 40 of the cords 26, the lower edge 20 of the shade portion 18 is drawn upward toward the stowed position. As the ends 40 are pulled downwardly, the shade portion 18 collapses and collects in cascading folds 36 beneath the headrail 12 in typical fashion for Roman-type shades. As is evident from FIG. 1, the cord guides 30A-30C and 30D-30F create the folds 36 and are disposed at corners or inflections of the folds 36 in the material 14 when the shade portion 18 is raised. While in the stowed position, the window in front of which the shade 10 is installed is typically (although not necessarily) substantially uncovered. The shade portion 18 may be unfolded by pulling on the cords 26, operating the cordlock 24 in an appropriate manner, and allowing the ends 40 of the cords 26 to move upwardly. In the deployed position, the window in front of which the shade 10 is installed is typically (although not necessarily) substantially covered. During movement the ends 40 of the cords 26 are able to travel freely upwardly and downwardly through the respective shrouds 32 as a result of the connection between the cords 26 and shade portion 18 being limited to a single attachment point (for example, the lowermost cord guides 30B, 30E), while the shrouds 32 have multiple connection points with the material 14 at the cord guides 30A-30C and 30D-30F.

As previously noted, a preferred aspect of the invention is to encase the cords 26 within the collapsible shrouds 32 and to secure the shrouds to the material 14 at spaced locations so that the cords 26 are unable to become loose or be pulled loose and hang free from the material 14. Encapsulating the cords 26 within the collapsible shrouds 32, and securing the shrouds 32 to the cord guides 30 makes the shade 10 less likely to pose a risk to children or others. To promote this safety feature further, the cord guides 30 are preferably spaced sufficiently close together to preclude a child from placing his or her head between one of the collapsible shrouds 32 and the adjacent rear face 14B of the material 14. For this purpose, adjacent cord guides 30 are preferably spaced, for example, not more than eight inches (about twenty centimeters) apart, and more preferably no more than about six inches (about fifteen centimeters) apart or less.

Figure 6:
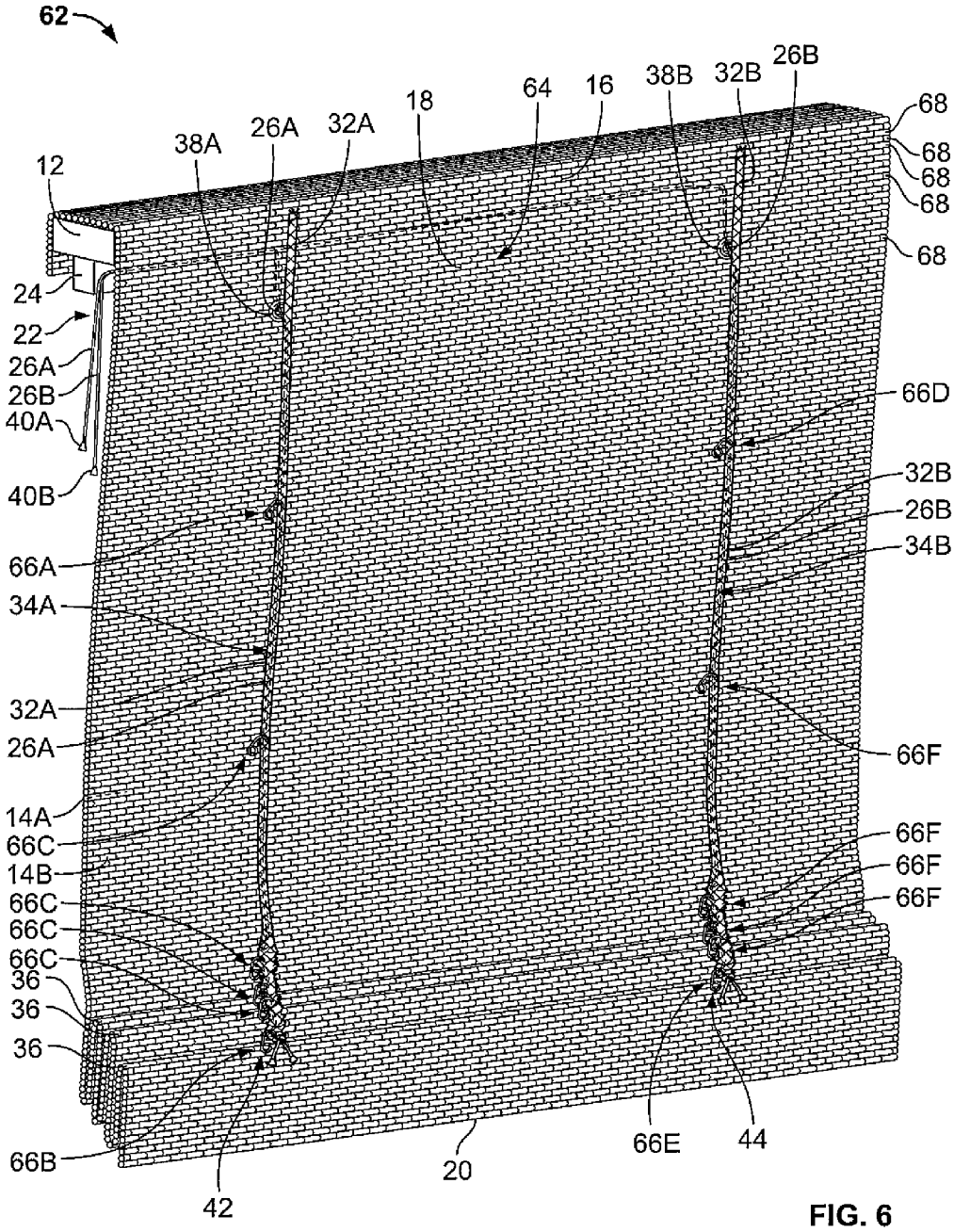
FIG. 6 comprises a rear isometric view of a window shade 62 in accordance with another embodiment.
Figure 7:
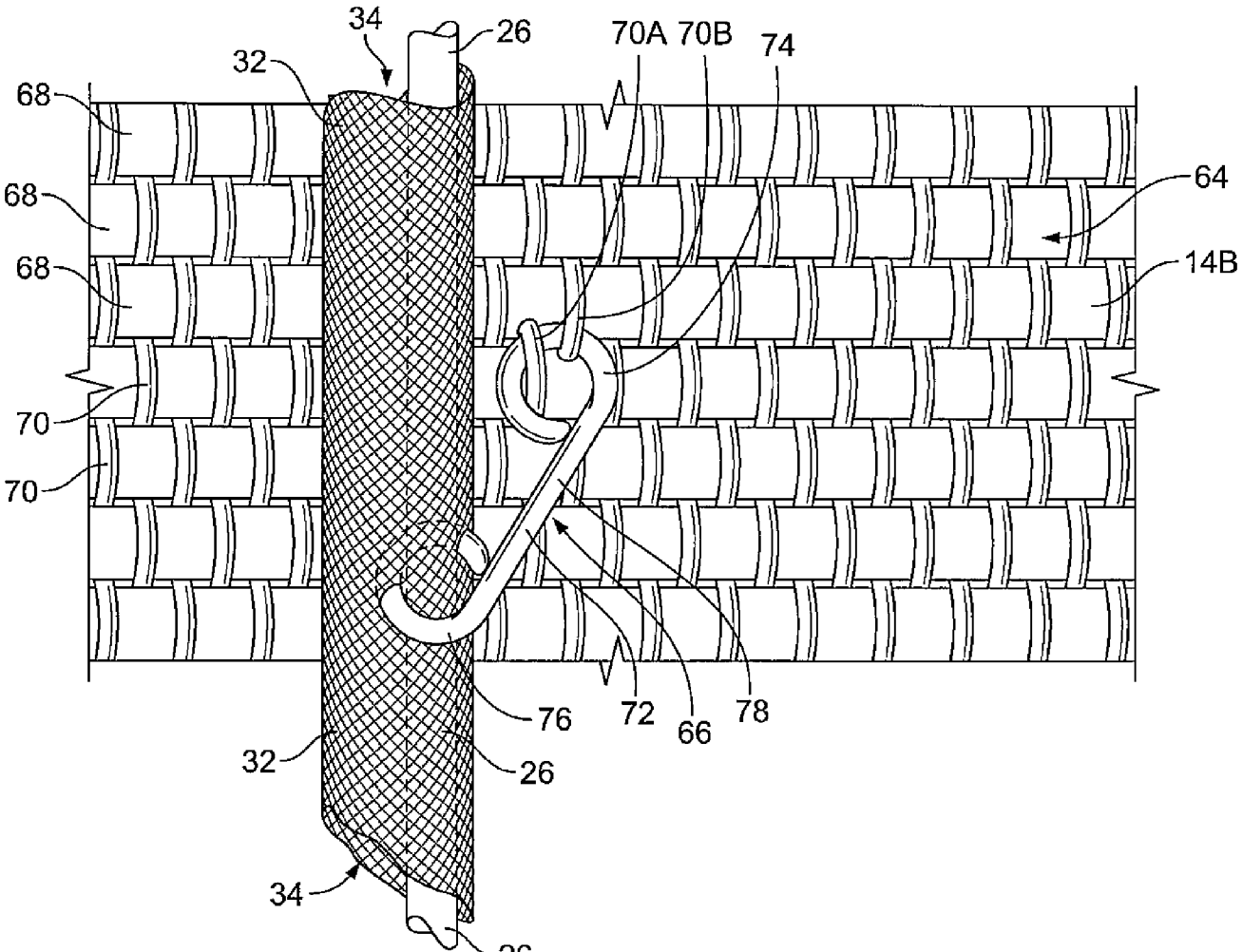
FIG. 7 comprises an enlarged, fragmentary, isometric view of the shade 62 of FIG. 6 showing the interrelation of the shading material 64, cord 26, shroud 32, and an alternative cord guide 66.

FIG. 6 illustrates an alternative window shade 62. The shade 62 is similar to the shade 10 illustrated in FIG. 1 in certain respects, with common elements being identified with identical numbers. The shade 62 otherwise differs with respect to the shading material 64 and the cord guides 66A-66F. The shading material 64 is formed of bamboo or wood rods or strips 68 woven together by a plurality of vertically extending weaves 70. The weaves 70 may be made of any suitable material, including fabric, cloth, metal, and wood. The weaves 70 extend continuously in front of, behind, and in between the rods 68 from the upper end 16 of the shading material 64 to the lower end 20 of the shading material 64.

Like the shade 10, the shade 62 has shrouds 32A, 32B that are stapled or otherwise attached to the upper end 16 of the shade 62. The shrouds 32A, 32B are also secured to vertically aligned cord guides 66A-66C and 66D-66F, respectively, that are, in turn, secured to the rear face 14B of the shading material 64. As can be seen in FIGS. 6-9, cord guides 66A-66F are comprised of metal wires 72 that include a first portion 74 and a second portion 76, as well as a straight connecting portion 78 that connects the two portions 74, 76. As in the first embodiment described above, the first and second portions 74, 76 are bent or otherwise formed preferably in a curved or hooked shape, including an open loop, a closed loop, or a plurality of open and/or closed loops. The wire is approximately 0.3 millimeters (0.01 inches) thick and approximately 2.7 millimeters (0.11 inches) long. In the illustrated embodiment, the portions 74, 76 are approximately 1.4 millimeters (0.05 inches) in diameter. In the shade 62 of FIGS. 6 and 7, the first portion 74 of each cord guide 66 extends about and is therefore attached to the shading material 64. More specifically, the first portion 74 is hooked about at least one, and preferably two adjacent weave portions 70A, 70B, such that the first portion 74 passes between the weave portions 70A, 70B and the wood rods 68, thereby securing each cord guide 66 to the shading material 64. The second portion 76 of each cord guide 66 is attached to the associated shroud 32. The wire 72 may be passed through gaps adjacent at least one, and preferably a plurality of adjacent strands of the woven material of the shroud 32 after or prior to attaching the cord guides 66 to the shading material 64. The wire 72 may then be bent into the desired shape to form the second portion 76. The second portion 76 prevents the wire 72 from becoming removed from the shroud 32. As an alternative, each wire 72 may be pre-formed with first and second portions 74, 76 and the first and second portions 74, 76 of the wires 72 may be extended about one or more strands of the woven material of the shroud 32 and through adjacent weave portions 70A, 70B of the shading material 64. Still further, multiple loop portions or multiple wires may also be used to provide redundancy and improve resiliency. Preferably, the second portion 76 is attached to the shroud 32 such that the encompassed cord 26 extends through the second portion 76.

Figure 8:
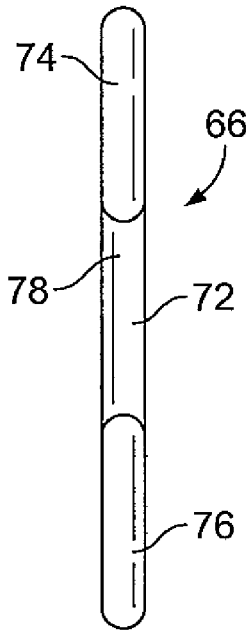
FIG. 8 comprises a side elevational view of the cord guide 66 shown in FIGS. 6 and 7.
Figure 9:
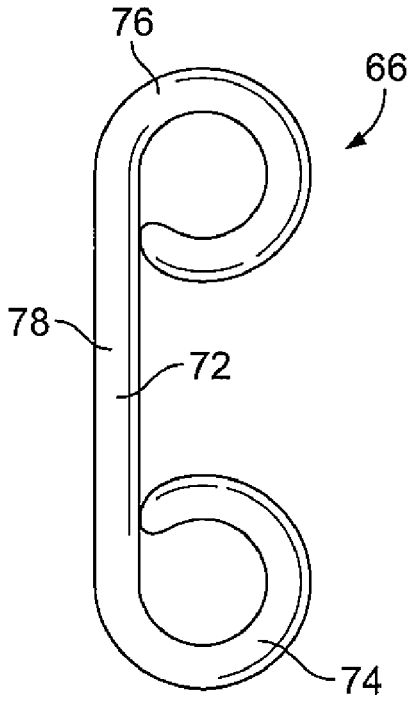
FIG. 9 comprises a front elevational view of the cord guide 66 shown in FIGS. 7 and 8.
Figure 10:
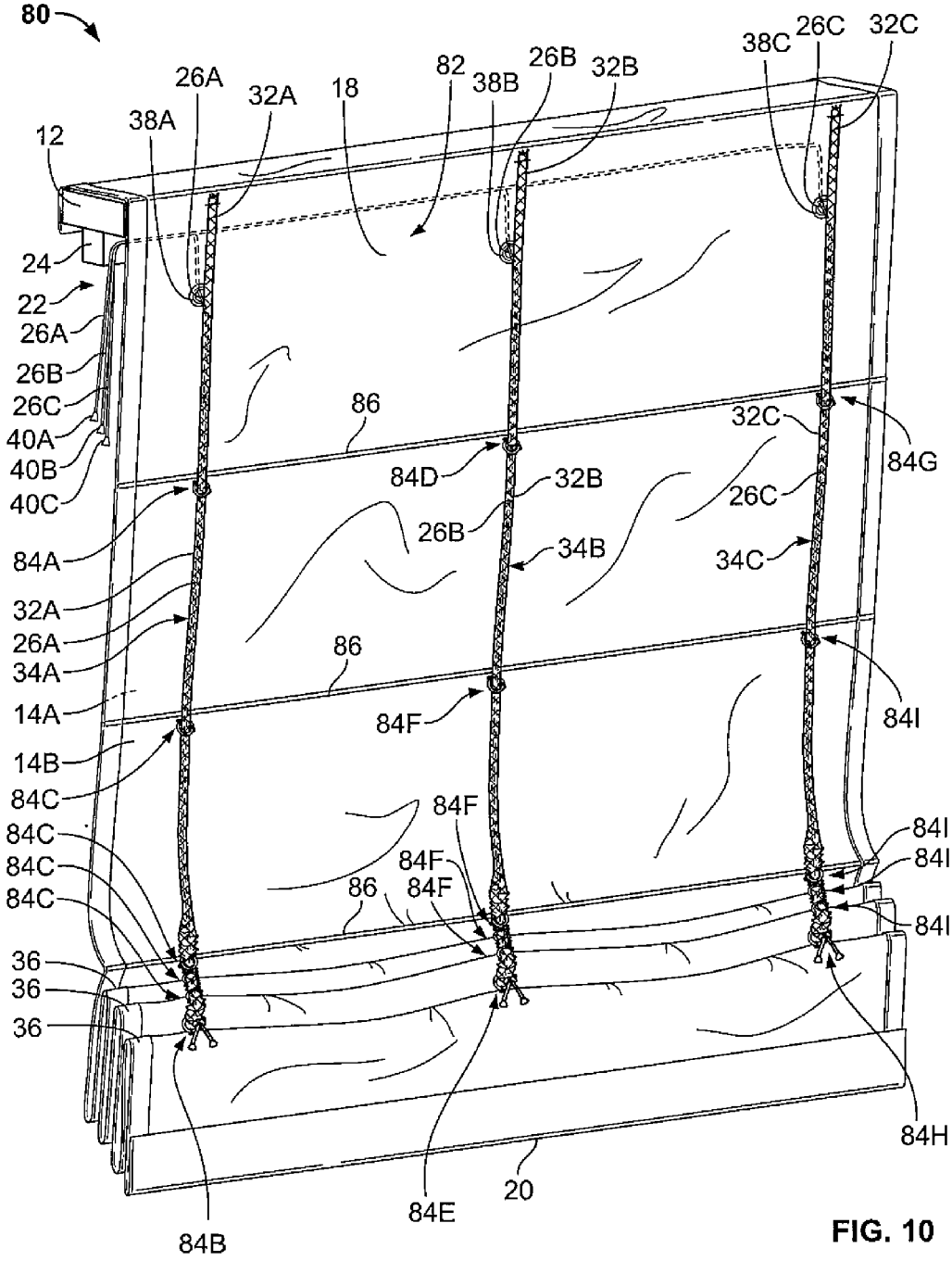
FIG. 10 comprises a rear isometric view of a window shade 80 in accordance with a further embodiment.

FIG. 10 illustrates yet another window shade 80. Again, elements common to FIGS. 1, 6, and 8 are assigned like reference numerals. The shade 80 again differs with respect to the shading material 82 and the cord guides 84A-84I. The shading material 82 of the shade 80 is a cloth fabric material, and may be formed from a single piece of material or multiple individual pieces of materials held together in some manner to form a flexible structure. The shade 80 also includes guide bars or rods 86 that extend laterally across the shading material 82. The guide bars 86 are generally disposed slightly above or below the cord guides 84A-84I to provide some rigidity in the flexible structure of shading material 82, and to create clean folds 36 when the shade 80 is raised to the stowed position. In FIG. 10, one or more guide bars 86 are hidden from view within one or more folds 36. The guide bars may be disposed in sleeves formed in the material 82.

Figure 11:
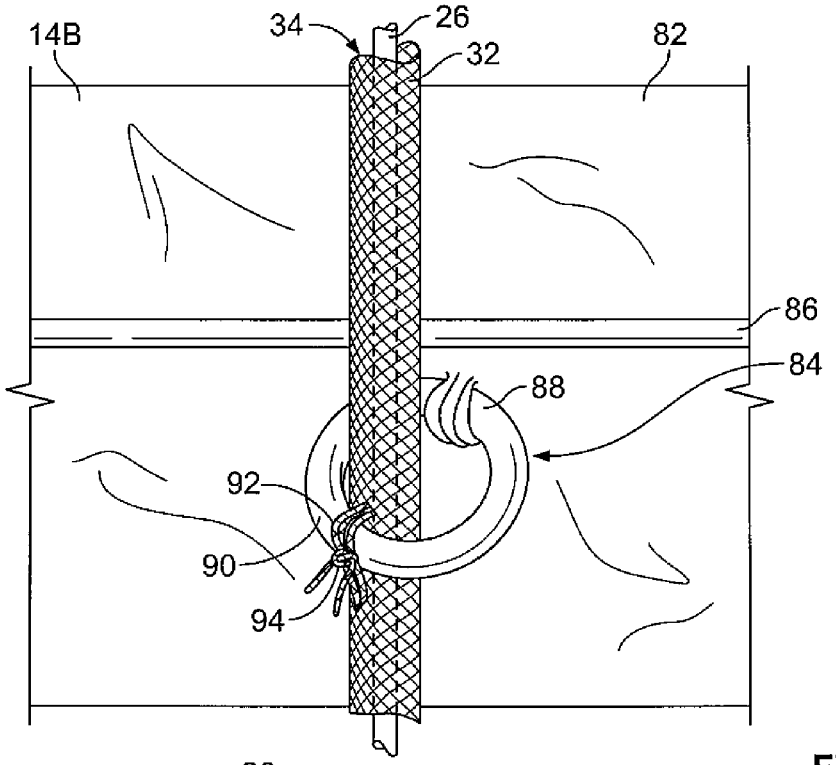
FIG. 11 comprises a fragmentary, enlarged, elevational view of the shade 80 of FIG. 10 showing the interrelation of a shading material 82, cord 26, alternative cord guide 84, and shroud 32.

The cord guides 84A-84I may comprise hollow rings or eyelets. The cord guides 84A-84I may be made of any suitable material, such as, but not limited to, plastic or metal. The cord guides 84A-84I are approximately 0.5 millimeters (0.19 inches) thick and have an outer diameter of approximately 3 millimeters (1.5 inches). As can be seen in FIG. 11, a first portion 88 of each cord guide 84 preferably has a curved or hooked shape that is attached to the shading material 82. The first portion 88 may be sewn to the shading material 82, but may also or alternatively be attached by other known means. A second portion 90 of each cord guide 84 also preferably has a curved or hooked shape that is attached to the shroud 32. Preferably, at least one strand 92 of the loosely woven shroud 32 material is separated from the main shroud 32, severed to create a loose end, and tied around the second portion 90 of each cord guide 84 to form a knot 94. Multiple strands of shroud 32 material may alternatively be used to make the knot 94, thereby increasing strength. In addition to, or as an alternative to, the knot 94, the strand(s) 92 of shroud 32 material may be secured to the cord guide 84 using adhesive, bonding, soldering, or other means known to those of ordinary skill in the art. In all of the embodiments disclosed herein, the strength of the attachment may be important because the stronger the method of attachment, the less chance there is that a child will be able to pull the collapsible shroud 32 off of the cord guides or the cord guides off of the shading material, thereby minimizing the chance that a child will be able to place his or her head between one of the collapsible shrouds 32 or cords 26 and the adjacent rear surface 14B of the material.

Figure 12:
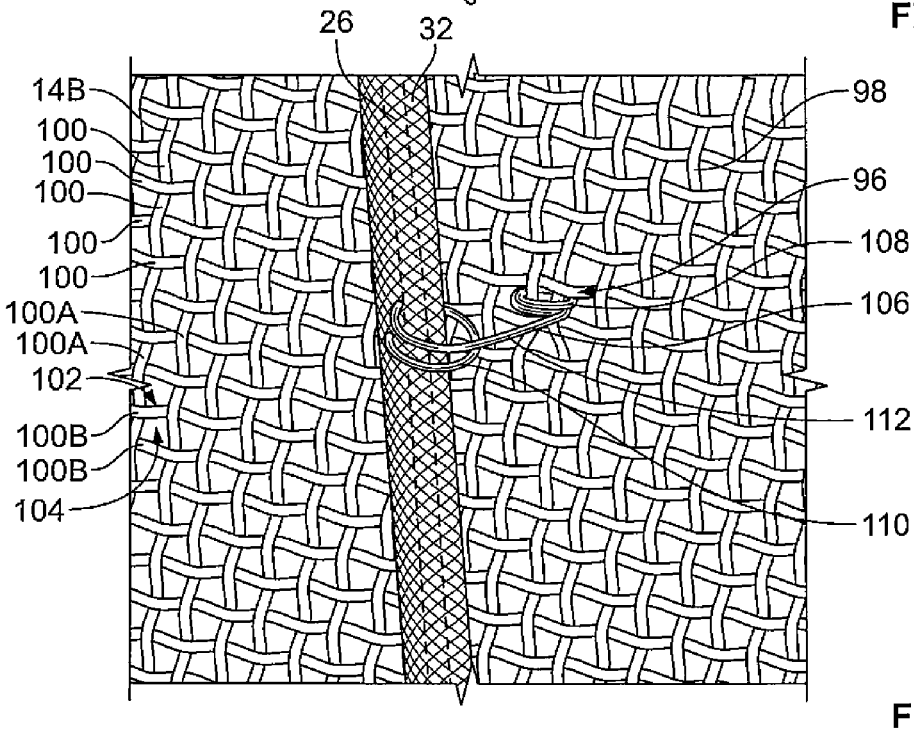
FIG. 12 comprises a fragmentary, enlarged, isometric view of an alternative cord guide 96 in conjunction with an alternative shading material 98, cord 26 and shroud 32.

FIG. 12 illustrates an example of an alternative cord guide 96 attached to a fragment of an alternative shading material 98. The shading material 98 is a composed of a plurality of resilient fiber strands 100. The shading material 98 may alternatively be made of plastic, metal, or other strands. The shading material 98 is arranged in a cross-hatched pattern with gaps or spaces 104 provided within. The cord guide 96 is comprised of a metal wire 106 that include a first portion 108 and a second portion 110, as well as a straight connecting portion 112 that connects the two portions 108, 110. Again, each portion 108, 110 may be formed preferably into a curved or hooked shape, including an open loop, a closed loop, or a plurality of open and/or closed loops. In the illustrated embodiment, the cord guide 96 is attached to the shading material 98 by passing the wire 106 through the gaps 104 in the shading material 98, then bending the wire 106 into a plurality of closed loops to form the first portion 108. The second portion 110 is attached to the shroud 32 in a similar fashion. The wire 106 may be passed through gaps between adjacent strands of the woven shroud 32 after or prior to attaching the cord guide 96 to the shading material 98. The wire may then be bent into a plurality of closed loops to form the second portion 110. The second portion 110 prevents the cord guide 96 from becoming removed from the shroud 32. As an alternative, the wire 106 may be pre-formed preferably with curved or hooked shapes and the wire 106 may be extended about one or more fiber strands 100 of the shading material 98 and through the woven material of the shroud 32. Still further, additional portions or additional wires may also be used to provide redundancy and improve strength. Preferably, the second portion 110 is attached to the shroud 32 such that the encompassed cord 26 extends through the second portion 110.

Figure 13:
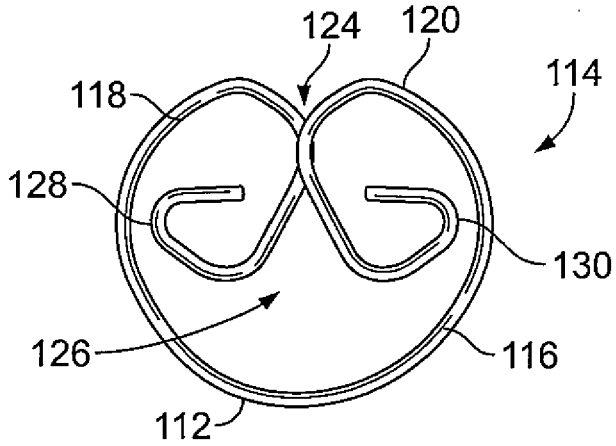
FIG. 13 comprises an enlarged plan view of an alternative cord guide 114.
Figure 14:
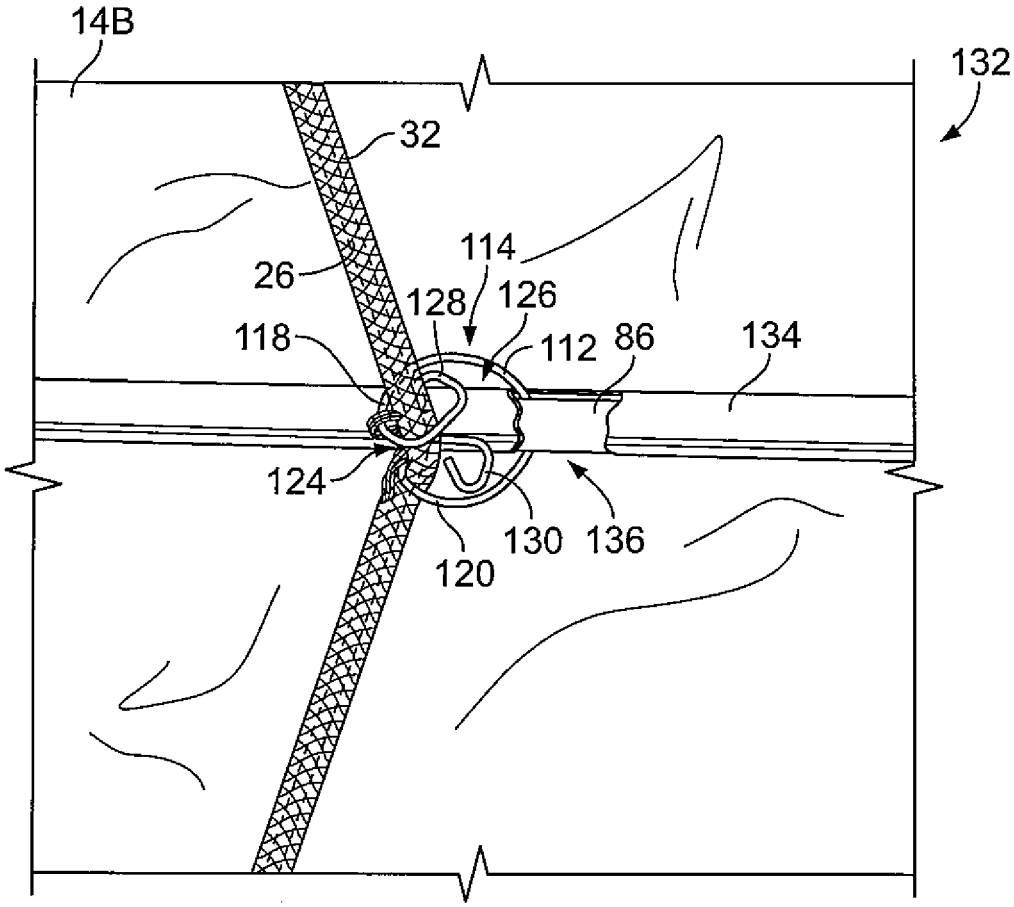
FIG. 14 comprises a fragmentary, enlarged, elevational view of an alternative window shade system 132 showing the interrelation of a shading material 82, cord 26, alternative cord guide 114, and shroud 32.

FIG. 13 illustrates yet another alternative cord guide 114. The cord guide 114 is similar to the cord guide 114 illustrated in FIGS. 6-9 in that the cord guide 114 is comprised of a metallic wire 116 that comprises a first portion 118 and a second portion 120, as well as a connecting portion 122 that connects the two portions 118, 120. However, unlike the cord guide 62 illustrated in FIGS. 6-9, the connecting portion 122 of the cord guide 114 in FIG. 13 is curved rather than straight. The curved connecting portion 122 creates a "v" shaped intersection 124 where the first and second looped potions 118, 120 overlap. The curved connecting portion 122 in combination with the intersection 124 creates an opening 126 within the cord guide 114. Further, the cord guide 114 includes a third portion 128 and a fourth portion 130 within the first and second portions 118, 120 respectively. Each of the first through fourth portions 118, 120, 128, and 130 preferably has a curved or hooked shape, including an open loop, a closed loop, or a plurality of open and/or closed loops, FIG. 14 illustrates the cord guide 114 in use with an alternative window shade 132. The shade 132 is similar to the shade 80 illustrated in FIG. 10 in many respects, with common elements being identified with identical numbers. The window shade 132 differs with regards to the cord guide 114 and the means by which the cord guide 114 is attached to the shroud 32 and shading material 82.

The shade 132 includes a shading material 82 made of flexible cloth or fabric material. The shade 132 also includes guide bars 86. The guide bars 86 are substantially enclosed in sleeves 134 that extend laterally across the shading material 82. The sleeves 134 are hollow enclosures sewn into the shading material 82 at regularly spaced intervals, preferably not more than eight inches (about twenty centimeters) apart, for example, and more preferably about six inches (about fifteen centimeters) apart or less. As in the previous embodiment, the guide bars 86 provide some rigidity in the flexible structure of shading material 82, and create neat folds 36 when the shade portion 18 is raised to a stowed, or partially stowed, position.

In FIG. 14, a section 136 of the sleeve 134 has been cut away to expose the guide bar 86. The exposed section 136 allows the cord guide 114 to be attached to the guide bar 86. With the guide bar 86 exposed, the first and second portions 118, 120 of the cord guide 114 can be pulled apart and wrapped around the guide bar 86. The first and second portions 118, 120 are then released and allowed to snap back to the original positions thereof as seen in FIG. 13, or are pushed back together into their original overlapping closed formation thereby securing the guide bar 86 to the cord guide 114 as shown in FIG. 14.

The cord guide 114 is connected to the shroud 32 in accordance with any of the embodiments described herein. For example, first and second looped portions 118, 120 of the cord guide 114 can be pulled apart and wrapped around the shroud 32, allowing the shroud 32, and optionally the enclosed cord 26, to extend through the opening 126. Once inside the opening 126, the shroud 32 may be attached to one or both of the third and fourth portions 128, 130 as well. Ends of the wire 116 of the third and fourth portions 128, 130 may be inserted through gaps between adjacent strands of the woven shroud 32, and strands may be wrapped around the third and fourth portions 128, 130 and moved to the point of intersection 124 of the first and second portions 118, 120. The moved strands may be captured by the overlapping portions of the cord guide 114. With the shroud 32 so attached, the first and second portions 118, 120 are resistant to being pulled apart, further securing the cord guide 114 to the guide bar 86.

Figure 15:
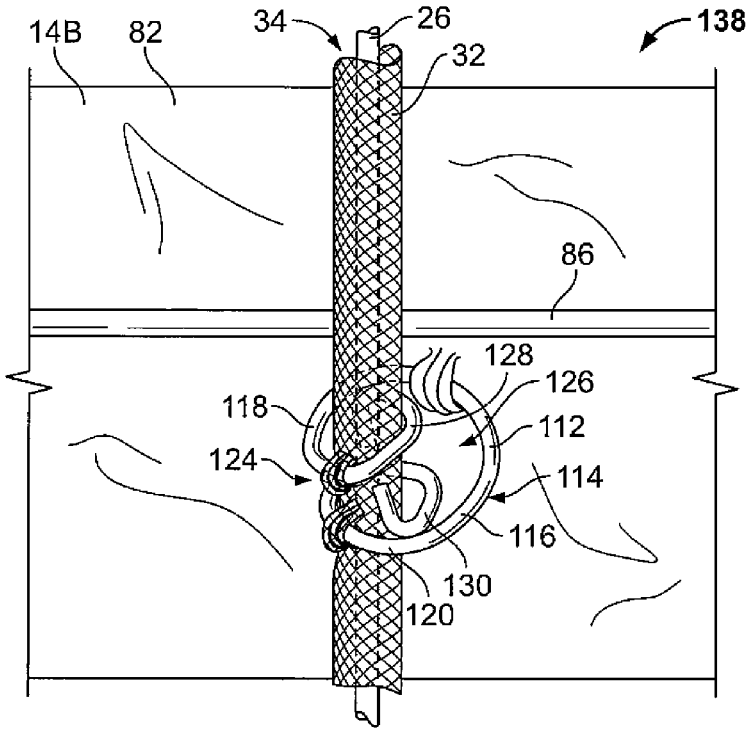
FIG. 15 comprises a fragmentary, enlarged, elevational view of yet another alternative window shade system 138 showing the interrelation of a shading material 82, cord 26, cord guide 114, and shroud 32.

FIG. 15 illustrates the cord guide 114 in use with yet another alternative window shade system 138. As before, common elements are assigned identical reference numerals. In this embodiment, the cord guide 114 is attached to the shading material 82 by sewing or otherwise securing the curved connecting portion 122 of the cord guide 114 to the shading material 82, rather than wrapping the cord guide 114 around a guide bar 86. The embodiment is otherwise identical to the embodiment of FIG. 14.

Figure 16:
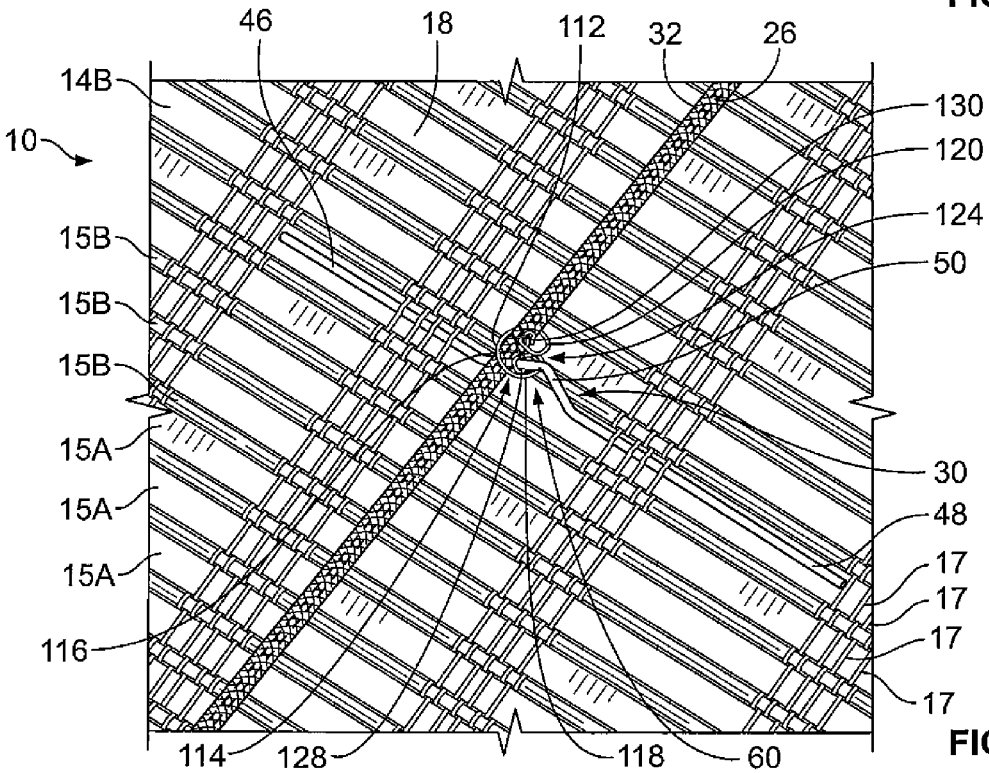
FIG. 16 comprises a fragmentary, enlarged, isometric view of the cord guide 114 of FIG. 11 in conjunction with the window shade system 10 of FIG. 1.

FIG. 16 illustrates the cord guide 114 in use with the shade 10 of FIG. 1 wherein the cord guide 114 replaces the wire 52. The cord guide 114 is attached to the cord guide 30 in largely the same way as the cord guide 114 is attached to the guide bar 86. Specifically, the first and second portions 118, 120 of the cord guide 114 are pulled apart and wrapped around the elbow 50 of the cord guide 30, thereby allowing the elbow 50 to extend through the opening 126 within the cord guide 114. Once the elbow 50 extends through the opening 126, the first and second portions 118, 120 are pushed back together into their original overlapping closed formation, or allowed to snap back to their original positions, thereby securing the cord guide 114 to the cord guide 30. Additionally, the cord guide 114 may be further secured to the elbow 50 by hooking the third portion 128 around the elbow 50. The cord guide 114 is similarly connected to the shroud 32, as described above. In this embodiment, the cord guides 114 and 30 together act as portions of a further overall cord guide, similar to the cord guides 30 of the first embodiment.

Industrial Applicability

The shades of the foregoing embodiments are not limited to the precise details disclosed herein, but may be modified to combine aspects of one embodiment with another embodiment (e.g., see FIG. 16). The shades disclosed herein may be assembled in an automated manner or by hand, or by a combination of both techniques. The use of rigid cord guides can increase serviceable life and thereby improve safety, and can facilitate automated assembly. Still further, the first, second, third, and/or fourth portions of the cord guides disclosed herein may have a linear shape, a non-linear shape, or may comprise a combination of linear and non-linear shapes.

Numerous further modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

I claim:

1. A window shade, comprising:

a headrail adapted for mounting adjacent a window;

a shading material having a first end attached to the headrail, a second end opposite the first end, and a first face between the first and second ends;

a cord disposed adjacent the face for moving the shading material between a stowed position in which the shading material is collected adjacent the headrail and a deployed position in which at least a portion of the shading material extends away from the headrail;

a shroud defining an internal passage through which the cord extends wherein the shroud is adapted to extend longitudinally as the shade portion is moved toward the deployed position and the shroud is adapted to collapse longitudinally as the shade portion is moved toward the stowed position; and first, second, and third spaced cord guides each being made of a rigid material and extending outwardly from the face, wherein the first cord guide is disposed at a first location, the second cord guide is disposed at a second location farther away from the headrail than the first location, and the third cord guide is disposed at a third location farther away from the headrail than the first and second locations, wherein the cord is secured to the shading material at a fourth location farther away from the headrail than the third location and wherein each cord guide includes a first portion secured to the shading material and a second portion extending away from the first portion and toward the shroud and secured to at least a portion of the shroud such that the cord is at least partially surrounded by the cord guide, and wherein the shroud is substantially unsecured to the shading material at least one location between adjacent cord guides.

2. The window shade of claim 1, wherein the cord guides are adapted to create and be disposed at folds in the shading material when the shading material is in the stowed position.

3. The window shade of claim 1, wherein adjacent cord guides are spaced a maximum of 20 centimeters apart.

4. The window shade of claim 1, wherein the shroud is a loosely woven material.

5. The window shade of claim 4, wherein the loosely woven material is formed of a low-friction polymeric material.

6. The window shade of claim 1, wherein the second portion of each cord guide comprises a loop.

7. The window shade of claim 1, wherein the first portion of each cord guide comprises a hooked member.

8. The window shade of claim 1, wherein the shroud is formed of a woven material and the first hooked portion of each cord guide extends through a gap between weaves of the material.

9. The window shade of claim 1, wherein the shroud is unsecured to the shading material at all locations between adjacent cord guides.

10. A window shade, comprising:

a headrail adapted for horizontal mounting adjacent and above a window;

a shading material having an upper end attached to the headrail and a lower end opposite the upper end;

means for raising and lowering the shading material relative to the headrail to define, respectively, a stowed position in which the shading material is collapsed and collected beneath the headrail and a deployed position in which the shading material is adapted to at least partially cover the window, the raising and lowering means comprising a cordlock mechanism mounted on the headrail and at least first and second cords that are each attached to the shading material adjacent the lower end thereof and extend upward toward the headrail and through the cordlock mechanism;

first and second sets of cord guides disposed on the shading material, each set of the first and second sets of cord guides being substantially vertically aligned so that a lowermost cord guide thereof is in proximity to the lower end of the shading material and an uppermost cord guide thereof is in proximity to the headrail, the first cord passing through the first set of cord guides and being attached to the lowermost cord guide, the second cord passing through the second set of cord guides and being attached to the lowermost cord guide; and first and second collapsible shrouds attached to each cord guide of the first and second sets of cord guides, respectively, each of the first and second collapsible shrouds defining an internal passage extending in a longitudinal direction thereof, the first and second cords being entirely disposed within the internal passages of the first and second shrouds, respectively, between the uppermost and lowermost cord guides of the first and second sets of cord guides, respectively;

wherein the first and second collapsible shrouds are adapted to longitudinally extend as the shading material is lowered toward the deployed position and the first and second collapsible shrouds are adapted to longitudinally collapse as the shading material is raised toward the stowed position; and wherein each cord guide includes a first rigid portion secured to the shading material and a second rigid portion secured to the shading material.

11. The window shade of claim 10, wherein the shading material has a rear face adapted to face the window and a front face adapted to face away from the window, and the first and second sets of cord guides are disposed on the rear face.

12. The window shade of claim 10, wherein the cord guides are adapted to create and be disposed at folds in the shading material when the shading material is in the stowed position.

13. The window shade of claim 10, wherein adjacent cord guides of each set of cord guides are spaced a maximum of 20 centimeters apart.

14. The window shade of claim 10, wherein adjacent cord guides of each set of cord guides are spaced a maximum of 15 centimeters apart.

15. The window shade of claim 10, wherein each of the first and second collapsible shrouds is a loosely woven material.

16. The window shade of claim 15, wherein the loosely woven material is formed of a low-friction polymeric yarn material.

17. The window shade of claim 10, wherein the window shade is installed on the window, the headrail is horizontally mounted adjacent and above the window, and the shading material is suspended downward from the headrail.

18. A method of using the window shade of claim 15, the method comprising the steps of raising and lowering the shading material between the stowed and deployed positions thereof by causing the first and second cords to travel through respective first and second collapsible shrouds.

19. The method of claim 18, wherein the cord guides of the first and second sets of cord guides create folds in the shading material as the shading material is raised to the stowed position.

20. The method of claim 18, wherein adjacent cord guides of each set of the first and second sets of cord guides are vertically spaced a maximum of 20 centimeters apart.

* * * * *